US006200200B1

(12) United States Patent
Himmelsbach

(10) Patent No.: US 6,200,200 B1
(45) Date of Patent: Mar. 13, 2001

(54) METHOD AND DEVICE FOR NON-CIRCULAR GRINDING OF CAM SHAPES WITH CONCAVE FLANKS

(75) Inventor: George Himmelsbach, Halslach (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 09/180,987

(22) PCT Filed: May 7, 1997

(86) PCT No.: PCT/EP97/02356

§ 371 Date: Feb. 16, 1999

§ 102(e) Date: Feb. 16, 1999

(87) PCT Pub. No.: WO97/44159

PCT Pub. Date: Nov. 27, 1997

(30) Foreign Application Priority Data

May 23, 1996 (DE) ..... 196 20 813

(51) Int. Cl.[7] ..... B24B 1/00; B24B 9/00

(52) U.S. Cl. ..... 451/62; 451/49; 451/56; 451/58; 451/72; 451/195; 451/246

(58) Field of Search ..... 451/5, 49, 56, 451/57, 58, 62, 65, 72, 178, 179, 195, 242, 246, 913

(56) References Cited

U.S. PATENT DOCUMENTS

| | | | |
|---|---|---|---|
| 2,654,189 | | 10/1953 | Dunn et al. . |
| 4,580,368 | * | 4/1986 | Smith . |
| 5,899,797 | * | 5/1999 | Junker ..... 451/62 |

FOREIGN PATENT DOCUMENTS

| | | |
|---|---|---|
| 529959 | 7/1931 | (DE) . |
| 678981 | 7/1939 | (DE) . |
| 1477912 | 11/1971 | (DE) . |
| 3309424 | 9/1983 | (DE) . |
| 4137924 | 2/1993 | (DE) . |
| 4426452 | 9/1995 | (DE) . |
| 2208275 | 3/1989 | (GB) . |
| 2271731 | 4/1994 | (GB) . |

* cited by examiner

*Primary Examiner*—Timothy V. Eley
(74) *Attorney, Agent, or Firm*—Jordan and Hamburg LLP

(57) ABSTRACT

A method and an apparatus are proposed for grinding cams having concave flanks on a camshaft, using a grinding wheel of relatively small diameter, which is used at least for finish-grinding. The axis of the grinding wheel runs at an angle to the camshaft longitudinal axis, and the grinding wheel is aligned at the same angle. In order to achieve a satisfactory running surface, the grinding wheel is tracked along an advance axis running perpendicular to the infeed axis, specifically as a function of the rotational position of the camshaft and of the positioning on the infeed axis.

19 Claims, 4 Drawing Sheets

METHOD AND DEVICE FOR NON-CIRCULAR GRINDING OF CAM SHAPES WITH CONCAVE FLANKS

The invention relates to a method and to an apparatus for grinding cams having concave flanks on a camshaft, and more particularly to a method and apparatus using a grinding wheel of relatively small diameter with a grinding zone arranged on the outer surface for the finish-grinding of the cam.

Cam shapes having concave flanks in the run-on and run-off region of the cam are increasingly employed, for example by car manufacturers, since their use contributes to a reduction in fuel consumption and as a result of the use of roller-lever valve-drive technology.

A method and an apparatus for producing such cam structures of known type are described, for example, in DE 44 26 452 C1. In accordance therewith, the axis of the grinding spindle is arranged parallel to the axis of rotation of the workpiece. Because of the space relationship and the small grinding-wheel diameter, this leads to the situation in which very slender, long grinding spindles have to be used, in particular when they are driven directly by a high-frequency motor, it being necessary for the grinding spindle to be designed to be longer than the camshaft. In the case of camshaft lengths of, for example, more than 500 mm, there are then problems in relation to the rigidity and the inherent vibration frequencies of the grinding spindle.

This is similarly true in the case of DE 41 37 924 C1, the subject-matter of which likewise concerns operating with a grinding spindle for the finish-grinding of the cam, the axis of the spindle running parallel to the axis of rotation of the workpiece.

According to yet another known approach, as disclosed in DE-PS 678 981, and as shown in FIGS. 3 to 6 thereof, operations are carried out with a grinding spindle aligned perpendicular to the camshaft axis. Here, the concave sub-area of the cam is ground out using a separate grinding wheel. This results in a shape error in the transition region to the concave cam section, since the cam shape is not finish-ground over its entire circumference using a grinding wheel. The diameter of the grinding wheel is limited by the fact that the respective cam, which is arranged alongside the cam to be ground in the direction of the camshaft longitudinal axis, predefines the maximum grinding wheel diameter through the maximum diameter of rotation of the second cam. In addition, in order to obtain a flat cam shape, it is necessary to operate with a movement or oscillation of the grinding wheel in the direction of the camshaft longitudinal axis, which is time-consuming and uneconomical.

Furthermore, it is known that cams are ground using a band grinding method. In accordance with such a system, the disadvantage is that the grinding bands have to be replaced frequently, and the cam running surface can only be ground flat. The circumstance of frequent grinding-band replacement leads to the fact that this system is uneconomical by comparison with grinding using ceramically bound CBN.

In addition, in order to grind oblique cams, the entire grinding unit has to be pivoted. From the point of view of the rectilinearity of the cam outer surface in the direction of the camshaft longitudinal axis, the accuracy values as in the case of grinding cannot be achieved.

The invention is based on the object of developing a method and an apparatus of the aforementioned known general type in such a way that the above-described disadvantages are eliminated and that, in particular at high accuracy, the finished machined camshaft can be worked with a very short and correspondingly rigid grinding-spindle design.

SUMMARY OF THE INVENTION

This object is achieved, in terms of the method, by providing a grinding wheel of relatively small diameter with a grinding zone arranged on an outer surface thereof for finish-grinding of the cam. An axis of a grinding spindle is aligned at a predetermined angle, preferably ranging from about 10° to 30° to a camshaft longitudinal axis, and grinding operations are carried out by tracking the grinding spindle, together with the grinding wheel, which is dressed at the predetermined angle of the grinding spindle, in the direction of a vertical advance axis running perpendicular to an infeed axis, such that the grinding zone of the grinding wheel is maintained at the same position on a generatrix of the grinding wheel. An apparatus in accordance with the invention permits carrying out of the aforementioned method.

According to the invention, by virtue of the oblique position of the grinding spindle, it is possible to operate with a small grinding-wheel diameter and nevertheless a very short and rigid grinding spindle. The accuracy of the finished machined camshaft results from the coordination of the movements of the grinding spindle in relation to three different CNC axes. As a result of the oblique position of the grinding spindle, the situation in the machine in relation to interfering edges is very greatly simplified. As a result, it is possible, for example, even to grind concave cam shapes with a small concave radius on long camshafts. In addition, the system is significantly more flexible than would be the case in the case of a grinding spindle, for the small grinding wheel, arranged parallel to the camshaft central axis.

As in the case of the band grinding method, the resulting advantages are that very small concave radii can be realized and that, by means of appropriate dressing of the grinding wheel, even spherical and oblique cam running tracks, with or without a chamfer, can be produced.

In the case of a grinding dimension of, for example, a few tenths of a millimeter, it is possible for the cam contour to be finish-ground using a single grinding wheel.

Further embodiments of the apparatus in accordance with the invention are also described, in which grinding operations are further enhanced .

The invention is explained in more detail below with reference to exemplary embodiments illustrated schematically in the accompanying drawings, in which like reference numerals designate the same elements.

DETAILED DESCRIPTION OF THE INVENTION

Figure 1:
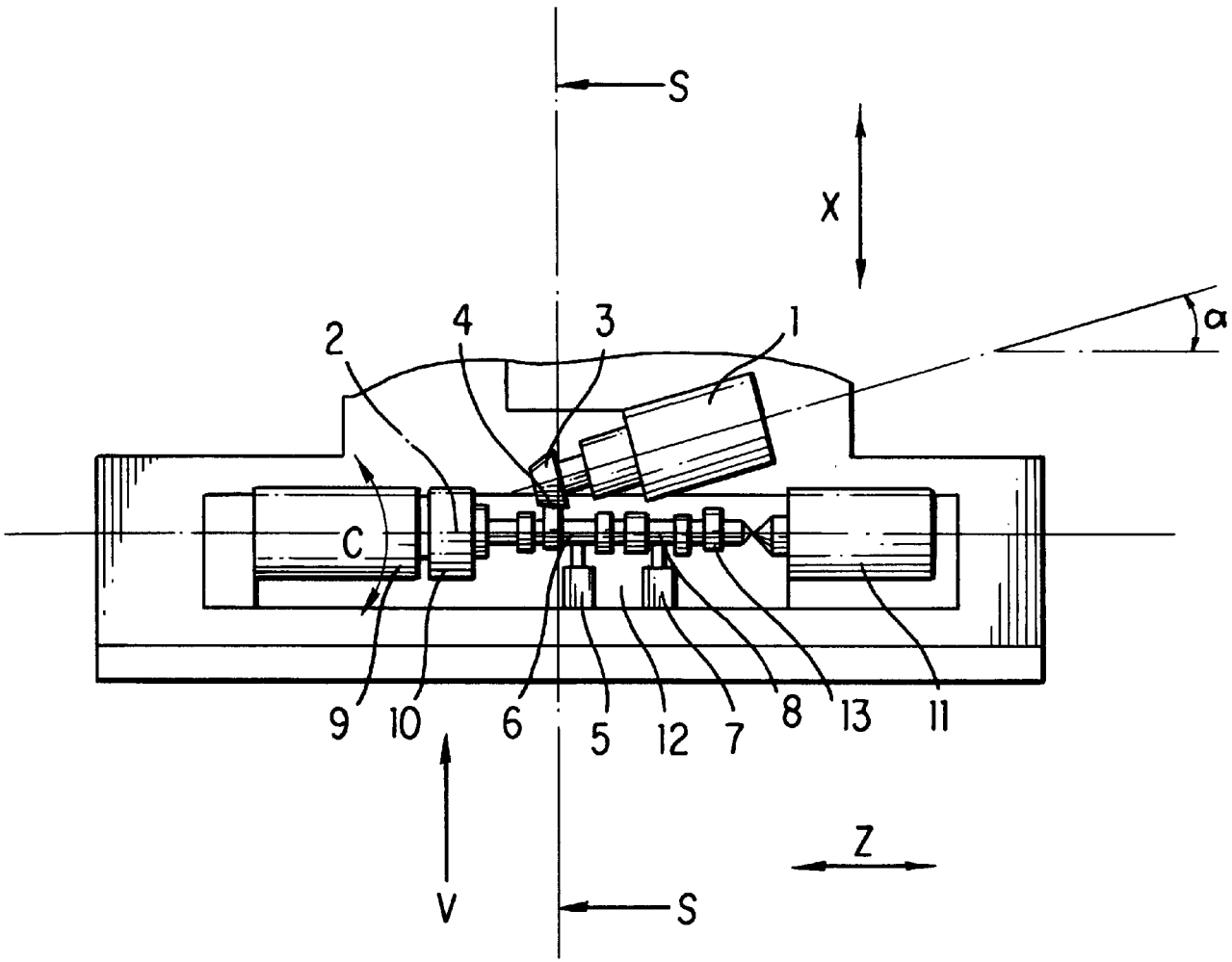
FIG. 1 is a plan view of an apparatus constructed in accordance with the invention.

FIG. 1 illustrates a grinding spindle 1 for grinding cams having a cam outer surface 17 that is parallel to a camshaft longitudinal axis 2 which is arranged at an angle $\alpha$ to the camshaft longitudinal axis 2. A grinding wheel 3 is dressed conically at the same angle, so that a grinding zone 4 of the grinding wheel 3 is in turn arranged parallel to the camshaft longitudinal axis 2. As a result of the oblique arrangement of the grinding spindle 1, the latter is significantly shorter and more rigid in design than if it were arranged parallel to the camshaft longitudinal axis 2. The angle $\alpha$ can be selected freely and preferably has a value between 10° and 30°, the magnitude of the angle depending on the camshaft geometry.

The camshaft 13 is accommodated between a workpiece headstock 9, on which chuck 10 is mounted, the latter being mounted so as to be rotatable about its longitudinal axis in extension of the axis of rotation 2 or the workpiece and a tailstock 11.

The workpiece headstock 9 and the tailstock 11 are firmly mounted on the grinding table 12. In order to support the camshaft 13 during the grinding, steady rests 5 and 7 are mounted on the grinding table 12 and prevent the camshaft 13 from bending during the grinding operation. The steady rests 5 and 7 support the camshaft 13 at its bearing points 6 and 8 in exact alignment between the longitudinal axis of the workpiece headstock 9 and of the tailstock 11.

The number of steady rests varies, depending on the geometry of the camshaft 13 and the required accuracies and machining times. Illustrated by way of example in FIG. 1 are two steady rests 5 and 7, which are mounted on the grinding table.

The grinding-spindle drive for the grinding spindle 1 having the small grinding wheel 3 can be implemented with a belt drive or as a high-frequency grinding-spindle unit.

The infeed axis X and the longitudinal positioning axis Z are illustrated in FIG. 1. The vertical advance axis Y has to be imagined as perpendicular to the plane of the drawing. The workpiece rotates about the axis of rotation C of the workpiece.

Figure 1A:
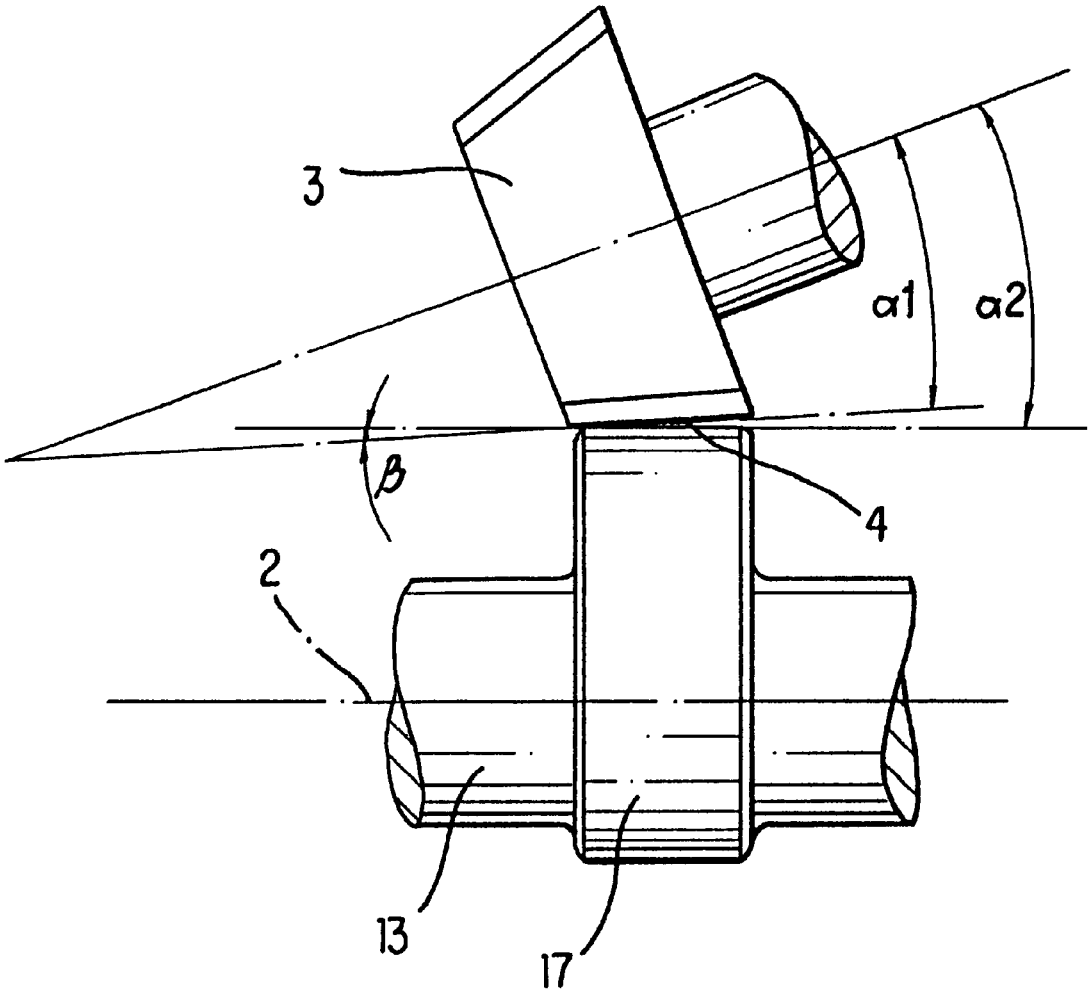
FIG. 1A is a partial detail of the apparatus illustrated in FIG. 1.

In the case of a small grinding dimension, the cam contour is produced only using the grinding wheel 3. However, it is also possible for a dedicated grinding wheel of larger diameter to be used for pre-grinding A partial detail from FIG. 1 is illustrated in FIG. 1A. In order to grind conical cams, which have a bevel angle $\beta$ on the cam outer surface 17 in the direction of the camshaft longitudinal axis 2, there are various possibilities.

In the case of a bevel angle $\beta$ of the cam outer surface 17, it is possible for the grinding wheel 3 to be dressed at an angle $\alpha_1$, so that ($\alpha_1+\beta=\alpha$) the bevel angle $\beta$ is dressed on the grinding wheel and the pivoting angle $\alpha$ of the grinding spindle 1 remains unchanged.

Another variant is that the grinding wheel 3 remains dressed to the angle and the grinding spindle 1 is pivoted horizontally by the angle $\beta$ ($\alpha\pm\beta=\alpha_2$).

According to FIG. 2, when the cam shape is being ground, the grinding zone 4 wanders above or below the theoretical camshaft longitudinal axis 2, because of the non-round contour of the cam 15, so that during one revolution of the cam, the grinding zone wanders between the points 4A and 4B on the grinding wheel. In the case of a grinding wheel brought obliquely into contact, this would normally lead to a distortion of the cam outer surface 17. In the case in which the grinding zone wanders between point 4A and point 4B, the cam outer surface 17 which, in the case of flat cams in the direction of the axis of rotation 2 of the workpiece should be parallel to the latter, becomes oblique in the region in which the grinding does not take place in the grinding zone 4. In order to prevent this, according to the invention, the grinding wheel 3, together with the entire grinding spindle 1, is tracked along the vertical advance axis Y in such a way that the grinding always takes place exactly in the grinding zone 4 illustrated in FIG. 2.

In order to obtain an optimum cam geometry during finish-grinding, it is necessary that the grinding zone 4 always remains precisely at the same position on the circumference of the grinding wheel 3.

The grinding zone 4 must be located on the grinding-wheel circumference on the grinding wheel 3 on the center line 20, which is in turn arranged parallel to the X axis.

Figure 2:
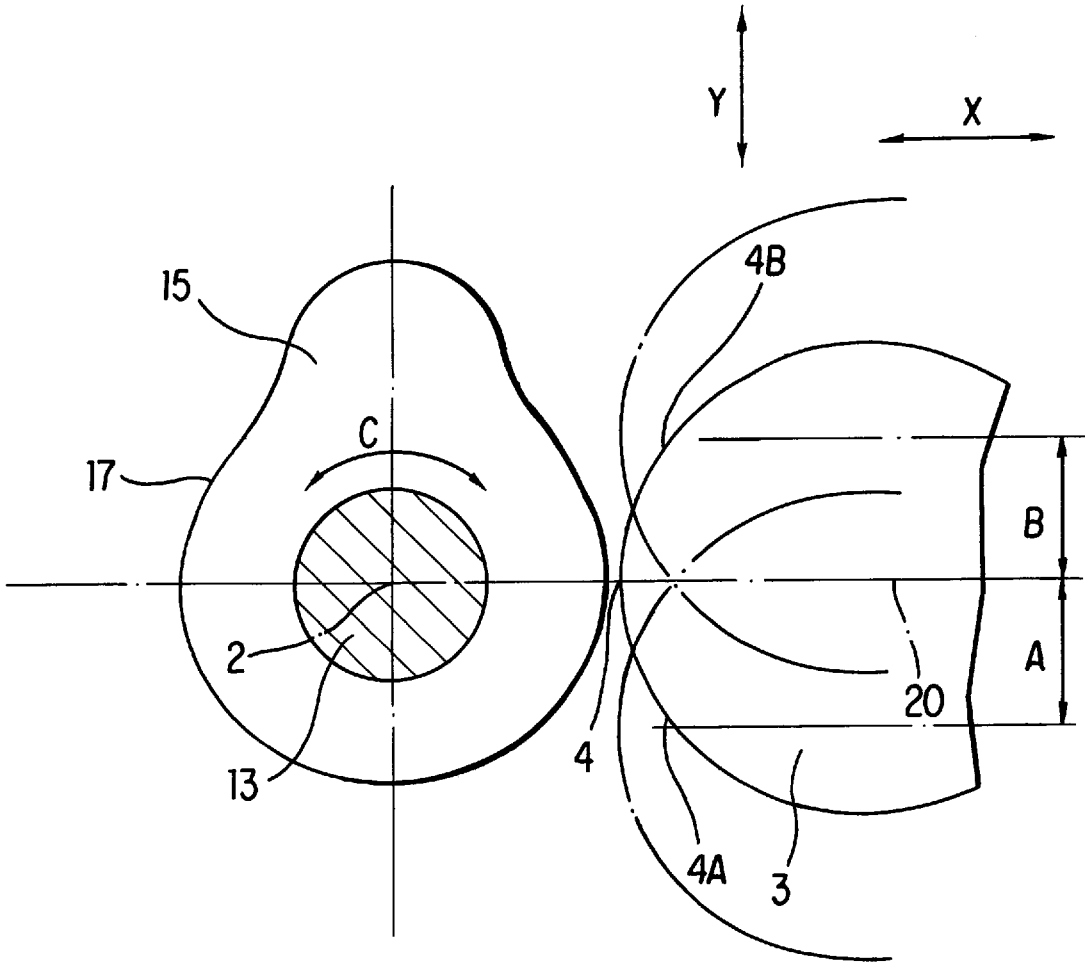
FIG. 2 is a sectional view taken through camshaft and grinding wheel corresponding to the section line S—S in FIG. 1.

This tracking of the grinding wheel 3 during the grinding of the cam shape is indicated in FIG. 2 by the two dimensions A and B.

Figure 3:
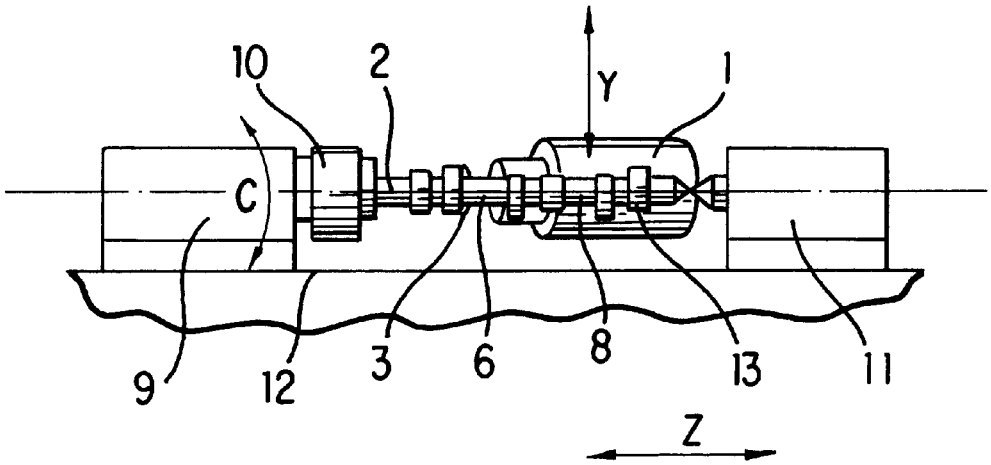
FIG. 3 is a front view of the apparatus illustrated in FIG. 1 in the direction of the arrow V.

FIG. 3 illustrates the vertical advance axis Y and the longitudinal positioning axis Z. In addition, the axis of rotation C of the workpiece is also shown here. The infeed axis X has to be imagined as running perpendicular to the plane of the drawing.

All the axes are implemented as CNC axes. The advance axis Y is used to keep the grinding zone 4 on the grinding wheel 3 always in the same position. The infeed axis X and the axis of rotation C of the workpiece serve to generate the cam shape, and therefore have to work in a coordinated operation. In order to keep the grinding zone 4 always on the same position on the grinding wheel 3, it is necessary for the vertical advance axis Y to be tracked as a function of the position of the infeed axis X and the axis of rotation C of the workpiece. It can be seen that the three axes X, Y and C have to operate in a direct functional relationship with one another, and are therefore operated in a coordinated manner.

Figure 4:
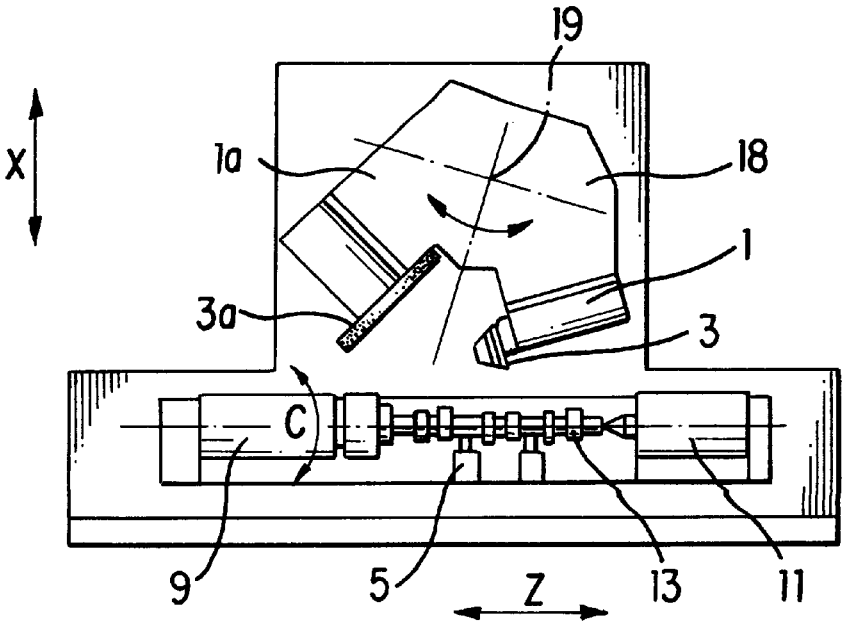
FIG. 4 is a plan view of a modified apparatus, in which operations are carried out with a dedicated pre-grinding wheel.

In the case of camshafts which have a relatively large grinding dimension, it is possible, for example, to use the design according to FIG. 4. This shows a design of a grinding machine having two grinding spindles, a first grinding spindle la being equipped to pre-grind an intermediate contour on the cam shape, using a first, large grinding wheel 3*a*, which has a diameter of 400 mm, for example. The first grinding spindle 1*a* does not need to be arranged so that it can move in the direction of the Y axis.

In general terms, the idea of the method is that, during the finish-grinding using the grinding wheel 3, an interpolating movement of the axes X, Y and C is carried out during grinding. It would also be possible instead of moving the grinding wheel 3 vertically using the grinding spindle 1, to mount this in a stationary manner in the direction of the Y axis and, for this purpose, to operate the workpiece headstock 9, together with the chuck 10, the steady rests 5 and 7 and the tailstock 11, i.e., the complete grinding-table fittings on the grinding table 12, vertically in interpolating operation in relation to the axes X and C. By this means, the same effect would be achieved with a changed apparatus construction.

The second grinding spindle 1, which can be pivoted in, serves to finish-grind the cam contour and accommodates at least one grinding wheel 3, and has the construction shown in FIGS. 1 to 3.

What is claimed is:

1. A method of grinding a cam having a concave flank on a camshaft, comprising:

providing a grinding wheel with a grinding zone for finish-grinding of the cam;

supporting said grinding wheel by a grinding spindle aligned along a spindle axis;

aligning said spindle axis at a predetermined angle of about 10° to 30° relative to a longitudinal axis of the camshaft, said grinding zone of said grinding wheel being defined by a conical outer surface of said grinding wheel which has been dressed relative to said spindle angle at a grinding zone angle which is substantially equivalent to said predetermined angle; and carrying out grinding operations on the camshaft by tracking the grinding spindle, along with the grinding wheel, in the direction of a vertical advance axis running perpendicular to an infeed axis and a longitudinal positioning axis of the grinding spindle, such that the grinding zone of the grinding wheel is maintained at a same position on a generatrix of the grinding wheel.

2. A method according to claim 1, further comprising:

implementing the longitudinal axis of the camshaft, the infeed axis and the advance axis as CNC axes; and tracking the advance axis as a function of the position of the longitudinal axis of the camshaft and of the infeed axis.

3. A method according to claim 1, wherein the infeed axis runs independently of the predetermined angle at 90° to the longitudinal axis of the camshaft.

4. A method according to claim 1, further comprising maintaining said predetermined angle, and dressing the grinding wheel obliquely at an angle of inclination, for producing cams with an inclined running surface having said angle of inclination.

5. A method according to claim 1, wherein cams with an inclined running surface are produced, the method further comprising adjusting the predetermined angle in either of two directions to permit production of said cams with the inclined running surface.

6. A method according to claim 1, further comprising moving the camshaft vertically in order to maintain the grinding zone at the same position on the generatrix of the grinding wheel.

7. A method according to claim 1, further comprising:

providing a second grinding spindle with a second grinding wheel relatively larger than said grinding wheel for pre-grinding; and finish grinding a shape of the cam, which includes the concave flank, with the grinding wheel.

8. A method according to claim 7, further comprising:

mounting both grinding spindles on a headstock, said head stock being pivotable about an axis running transversely with respect to the longitudinal axis of the camshaft; and pivoting said headstock to bring one of the second grinding wheel and the grinding wheel into an operating position.

9. An apparatus for grinding a cam having concave flanks on a camshaft, the apparatus comprising:

a mechanism for rotatably supporting the camshaft for rotation about a rotational axis of the camshaft;

a grinding wheel with a grinding zone for finish-grinding of the cam;

a grinding spindle aligned along a spindle axis for supporting the grinding wheel, said spindle axis being arranged at a predetermined angle of about 10° to 30° relative to the rotational axis of the camshaft, said grinding zone of said grinding wheel being defined by a conical outer surface of said grinding wheel which has been dressed relative to said spindle angle at a grinding zone angle which is substantially equivalent to said predetermined angle; and a mechanism for producing coordinated movement of the grinding wheel along an infeed axis and an advance axis running perpendicular thereto in relation to the axis rotation of the camshaft, the grinding wheel being tracked such that the grinding zone is maintained at a same position on a generatrix of the grinding wheel.

10. An apparatus according to claim 9, wherein:

the axis of rotation of the camshaft, the infeed axis and the advance axis are implemented as CNC axes; and the advance axis is tracked as a function of the position of the rotational axis of the camshaft and of the infeed axis.

11. An apparatus according to claim 9 or 10, wherein the infeed axis runs independently of the predetermined angle at 90° to the rotational axis of the camshaft.

12. An apparatus according to claim 9 or 10, wherein, for producing cams with an inclined running surface having an angle of inclination, the predetermined angle is maintained and the grinding zone angle of the grinding wheel which is defined by the conical outer surface of said grinding wheel, and which is substantially equivalent to said predetermined angle, is varied obliquely at the angle of inclination.

13. An apparatus according to claim 9 or 10, wherein the predetermined angle is adjustable in either of two directions to permit production of cams with an inclined running surface.

14. An apparatus according to claim 9 or 10, wherein, in order to maintain the grinding zone at the same position on the generatrix of the grinding wheel, said mechanism for rotatable supporting the camshaft is movable vertically, thereby permitting the camshaft supported thereby to be moved vertically.

15. An apparatus according to claim 9 or 10, wherein a second grinding spindle with a second grinding wheel relatively larger than said grinding wheel is used for pre-grinding, and the cam shape, including the concave flanks, is finish-ground with the grinding wheel.

16. An apparatus according to claim 15, further comprising a headstock on which both grinding spindles are mounted, said head stock being pivotable about an axis running transversely with respect to the rotational axis of the camshaft, pivoting thereof bringing the second grinding wheel and the grinding wheel into an operating position.

17. An apparatus according to claim 9, further comprising a mechanism for coordinated movement of the grinding wheel along the infeed axis and the advance axis in relation to the axis of rotation of the workpiece.

18. An apparatus according to claim 17, wherein the infeed axis runs independently of the predefined angle, at about 90° to the axis of rotation of the workpiece.

19. An apparatus according to claim 17, further comprising a further grinding wheel, having a larger diameter than said grinding wheel, for pre-grinding of the cam, said further grinding wheel being mounted together with the grinding wheel on a pivotable headstock.

* * * * *